United States Patent [19]

Martischius et al.

[11] Patent Number: 4,871,375

[45] Date of Patent: Oct. 3, 1989

[54] FUELS FOR OTTO ENGINES

[75] Inventors: Franz-Dieter Martischius, Neustadt; Knut Oppenlaender, Ludwigshafen; Hans-Henning Vogel, Frankenthal, all of Fed. Rep. of Germany

[73] Assignee: BASF Aktiensellschaft, Ludwigshafen, Fed. Rep. of Germany

[21] Appl. No.: 221,757

[22] Filed: Jul. 20, 1988

[30] Foreign Application Priority Data

Jul. 30, 1987 [DE] Fed. Rep. of Germany ..... 3725272
Jan. 16, 1988 [DE] Fed. Rep. of Germany ..... 3801107

[51] Int. Cl.[4] ..... C10L 1/18; C10L 1/22
[52] U.S. Cl. ..... 44/71
[58] Field of Search ..... 44/71

[56] References Cited

U.S. PATENT DOCUMENTS

| | | | |
|---|---|---|---|
| 2,654,660 | 10/1953 | Mitchell et al. . | |
| 2,699,427 | 1/1955 | Smith et al. | 44/71 |
| 2,718,503 | 9/1955 | Rocchini | 44/71 |
| 2,982,629 | 5/1961 | Andress, Jr. et al. | 44/71 |
| 3,046,102 | 7/1962 | Andress, Jr. et al. | 44/71 |
| 3,192,160 | 6/1965 | Gee et al. | 44/71 |
| 3,264,075 | 8/1966 | Gee et al. . | |

FOREIGN PATENT DOCUMENTS

| | | |
|---|---|---|
| 0006527 | 6/1979 | European Pat. Off. . |
| 3620651 | 3/1987 | Fed. Rep. of Germany . |
| 1396716 | 5/1964 | France . |
| 1458938 | 11/1964 | France . |
| 2252868 | 12/1973 | France . |

*Primary Examiner*—Jacqueline V. Howard
*Attorney, Agent, or Firm*—Keil & Weinkauf

[57] ABSTRACT

The invention relates to fuels for Otto engines containing small proportions of the alkali-metal or alkaline-earth-metal salts of amic acids of the general formula $$R^1R^2N—CO—A—COOH$$

or of analogous partial amides of tricarboxylic or tetracarboxylic acids whose carbamoyl groups have the general formula $$R^1R^2N—CO—,$$

where A is the bivalent radical vinylene, ethylene, trimethylene, or tetramethylene and either $R^1$ and $R^2$ are identical or different, substituted or unsubstituted alkyls or alkenyls of from 5 to 75 carbon atoms or $R^1$ is hydrogen and $R^2$ is the group of the general formula $$R^3R^4N—[C_nH_{2n}O]_x—C_nH_{2n}—,$$

where $R^3$ and $R^4$ are identical or different hydrocarbon radicals of from 1 to 18—preferably from 4 to 13—carbon atoms, n is 3 or 4 (or 3 and 4), and x is from 4 to 99.

8 Claims, No Drawings

FUELS FOR OTTO ENGINES

The present invention relates to fuels for four-stroke gasoline engines (Otto engines) containing alkali-metal or alkaline-earth-metal salts of the partial amides of dicarboxylic, tricarboxylic, or tetracarboxylic acids.

The addition of small proportions of the alkali-metal or alkaline-earth-metal salts of certain derivatives of succinic acid to fuels to prevent or reduce wear at the valves of Otto engines is known from DE-OS 36 20 651. However, these compounds have the disadvantage that they do not satisfactorily reduce corrosion in Otto engines.

It is therefore an aim of the present invention to provide substances that both prevent or reduce wear at the valves of Otto engines and reduce corrosion in those engines.

This and other aims and advantages are attained by fuels for Otto engines containing small proportions of the alkali-metal or alkaline-earth-metal salts of amic acids of the general formula $$R^1R^2N—CO—A—COOH$$

or of analogous partial amides of tricarboxylic or tetracarboxylic acids whose carbamoyl groups have the general formula $$R^1R^2N—CO—,$$

where A is the bivalent radical vinylene, ethylene, trimethylene, or tetramethylene and either $R^1$ and $R^2$ are identical or different, substituted or unsubstituted alkyls or alkenyls of from 5 to 75 carbon atoms or $R^1$ is hydrogen and $R^2$ is the group of the general formula $$R^3R^4N—[C_nH_{2n}O]_x—C_nH_{2n}—,$$

where $R^3$ and $R^4$ are identical or different hydrocarbon radicals of from 1 to 18—preferably from 4 to 13—carbon atoms, n is 3 or 4 (or 3 and 4), and x is from 4 to 99.

The novel fuel additives have the advantages that they do not pollute Otto engines in any way but at the same time prevent or greatly diminish wear at the valves, and that, surprisingly, they also considerably reduce or even prevent corrosion in the engines.

The novel alkali-metal or alkaline-earth-metal salts of the amic acids are derived from the dicarboxylic acids maleic acid, succinic acid, glutaric acid, or adipic acid. They are prepared by known methods, for instance by treating maleic, succinic, or glutaric anhydride with an approximately equimolar proportion of the appropriate amine, at a temperature of generally from 50° C. to 100° C., preferably from 60° C. to 90° C., and adding a basic alkali-metal or alkaline-earth-metal compound such as the hydroxide, carbonate, or alkoxide to the amic acid that is formed.

The compounds derived from adipic acid can be prepared by, for instance, treating adipic acid with an approximately equimolar proportion of the appropriate amine, at a temperature of generally from 120° C. to 180° C., preferably from 130° C. to 170° C., in the presence of an acid catalyst such as p-toluenesulfonic acid, the water formed being removed by vacuum or azeotropic distillation, and adding a basic alkali-metal or alkaline-earth-metal compound such as the hydroxide, carbonate, or alkoxide to the amic acid that is formed.

The reaction with maleic anhydride in particular can be carried out in the following way, for example. The maleic anhydride is placed in the reaction vessel first, for instance in molten form, and the amine is stirred in at a temperature of from 60° C. to 80° C. When the reaction is complete the maleamic acid is converted to the potassium salt, for instance, by the addition of the approximate stoichiometric amount of potassium methoxide in methanol, and the methanol is finally distilled off.

The novel alkali-metal or alkaline-earth-metal salts of the partial amides of tricarboxylic or tetracarboxylic acids are preferably derived from the tricarboxylic acids citric acid and nitrilotriacetic acid or the tetracarboxylic acid ethylenediaminetetraacetic acid.

The partial amides of the tricarboxylic acids are carbamoyl-substituted dicarboxylic acids or, preferably, dicarbamoyl-substituted carboxylic acids, and the carboxyl groups are fully neutralized by the ions of alkali or alkaline-earth metals. The partial amides of the tetracarboxylic acids are carbamoyl-substituted tricarboxylic acids, dicarbamoyl-substituted dicarboxylic acids, or, preferably, tricarbamoyl-substituted carboxylic acids, and again the carboxyl groups are fully neutralized by the ions of alkali metals or alkaline-earth metals.

The alkali-metal or alkaline-earth-metal salts of the partial amides of the tricarboxylic and tetracarboxylic acids are prepared by known methods. For instance, a given amount of the acid is treated with the appropriate amine in the required proportion (the same amount, twice the amount, or three times the amount, depending on whether the mono-, di-, or tricarbamoyl compound is required), at a temperature of generally from 120° C. to 180° C., preferably from 130° C. to 170° C., in the presence of an acid catalyst such as p-toluenesulfonic acid, the water formed being removed by vacuum or azeotropic distillation, and the partial amide formed is converted to the salt by treatment with a basic alkali-metal or alkaline-earth-metal compound such as the hydroxide, carbonate, or alkoxide.

The reaction with citric acid in particular can be carried out in the following way. For example, the citric acid and the required amount of the amine are placed in the reaction vessel and stirred together at a temperature of from 150° C. to 160° C. until the required partial amide is formed. When reaction is complete the acid is converted to the potassium salt, for instance, by the addition of the approximately stoichiometric amount of potassium methoxide in methanol, and the methanol is removed by distillation.

The amines used for preparation of the novel alkali-metal or alkaline-earth-metal salts of the partial amides of di-, tri, and tetracarboxylic acids include those of the general formula $NHR^1R^2$, where $R^1$ and $R^2$ are identical or different, substituted or unsubstituted alkyls or alkenyls of from 5 to 75 carbon atoms, preferably from 5 to 50 carbon atoms, above all from 8 to 30 carbon atoms. Examples of suitable amines include bis(2-ethylhexyl)amine and dioleylamine; diisotridecylamine can be used to particular advantage.

Also among the amines used for the preparation of the novel alkali-metal or alkaline-earth-metal salts of the partial amides of di-, tri-, and tetracarboxylic acids are those of the general formula $$R^3R^4N—[C_nH_{2n}O]_x—C_nH_{2n}—NH_2, \quad (I)$$

where $R^3$ and $R^4$ are identical or different hydrocarbon radicals of from 1 to 18—preferably from 4 to 13—carbon atoms, n is 3 or 4 (or 3 and 4), and x is from 4 to 99.

Amines of the general formula I are prepared by known methods, for instance from amines of the general formula $NHR^3R^4$ (II), which can be treated with propylene oxide or butylene oxide in the presence of an alkali such as potassium hydroxide, sodium hydroxide, or sodium methoxide at elevated temperatures, from 120° C. to 150° C. for instance, to obtain amino alcohols of the general formula $$R^3R^4N—[C_nH_{2n}O]_x—C_nH_{2n}—OH, \quad (III)$$

The amino alcohols III can also be obtained by first treating an amine II with an equal amount of propylene oxide, butylene oxide, or a mixture of propylene and butylene oxides, at a temperature of generally from 60° C. to 120° C., preferably from 80° C. to 100° C., in the absence of alkali, giving an amino alcohol of the general formula $R^3R^4N—C_nH_{2n}—OH$, which is then converted to an amino alcohol III by the addition of more propylene or butylene oxide in the presence of alkali, for instance 0.1–0.3% sodium or potassium hydroxide solution. The amino alcohols III are finally converted to the diamines I by simultaneous aminolysis and hydrogenation, that is to say, by treatment with approximately stoichiometric amounts of ammonia and hydrogen over a usual hydrogenation catalyst, for instance Raney nickel. This reaction is generally carried out under a pressure of from 150 bar to 250 bar at a temperature of from 200° C. to 250° C.

Of the novel salts of the partial amides of di-, tri-, and tetracarboxylic acids the potassium salts are preferred as fuel additives.

As a rule the mass fraction of the novel fuel additives in fuels for Otto engines is from 10 ppm to 2000 ppm, preferably from 50 ppm to 1000 ppm.

The fuels described in the invention can contain known phenolic or amine antioxidants in addition to the novel alkali-metal or alkaline-earth-metal salts. In particular it is advantageous to combine fuel additives for cleaning the intake system and keeping it clean and phenolic antioxidants for increasing the storage stability of the fuel.

Oily residues from oxo alcohol syntheses have proved to be good solvents or solution promoters for the fuel additives mentioned. Preference is given to residues from the synthesis of butanol, isobutanol, pentanol, hexanol, heptanol, octanol, nonanol, decanol, undecanol, and dodecanol. The use of residues from the oxo synthesis of butanol is particularly advantageous.

Other solvents or mixtures of solvents can also be used provided they give a homogeneous mixture of the components in the proportions mentioned previously.

The action of the novel gasoline additives is not restricted to gasoline for road vehicles: it has been found that they can also be used in aviation fuels, especially those for piston engines. The novel additives likewise function in both engines with carburetors and engines with fuel injection.

Fuels containing the novel additives can also contain other usual additives, for instance octane improvers or components containing oxygen, such as methanol, ethanol, or methyl tert-butyl ether.

The following examples illustrate the invention.

EXAMPLE 1

To demonstrate the favorable effect of the novel fuels on the corrosion of Otto engines, unleaded super gasoline containing no additives (a product of Erdöl-Raffinerie Mannheim GmbH) was subjected to corrosion tests in accordance with DIN 51 585, ASTM D 665-60, and IP 135/64. The tests were carried out at 23° C. over a period of 5 h. The following potassium salts were used as additives:

$$(iso—C_{13}H_{27})_2N—CO—CH{=}CH—COOK \quad (IV)$$

$$(iso—C_{13}H_{27})_2N—CO—CH_2C(OH)(COOK)CH_2—CO—N(iso—C_{13}H_{27})_2 \quad (V)$$

The results of the tests are given in the following table.

| Test No. | Additive | Mass fraction | Degree of corrosion |
|---|---|---|---|
| 1 | none | — | 6 |
| 2 | IV | 170 ppm | 1 |
| 3 | IV | 85 ppm | 2 |
| 4 | V | 180 ppm | 1 |
| 5 | V | 90 ppm | 2 |

EXAMPLE 2

To demonstrate the favorable effect of the novel fuel on wear at the exhaust-valve seats of Otto engines, vehicles powered by Otto engines were subjected to road tests extending over 20 000 km. The engines were driven in one series by unleaded gasoline without the novel additive and in another series by unleaded gasoline containing the novel potassium salt IV (170 ppm and 85 ppm) or the novel potassium salt V (180 ppm and 90 ppm) specified in Example 1.

At the end of the road tests over 20 000 km the engines driven by unleaded gasoline without the novel additive showed slight wear at the valve seats. No wear could be found at the valve seats of the engines driven by unleaded gasoline containing the novel additives.

We claim:

1. A fuel for Otto engines containing a fuel and 10 to 2000 ppm of an additive of an alkali-metal or alkaline-earth-metal salts of amic acids of the formula $$R^1R^2N—CO—A—COOH$$

or of analogous partial amides of tricarboxylic or tetracarboxylic acids whose carbamoyl groups have the formula $$R^1R^2N—CO—,$$

where A is the bivalent radical vinylene, ethylene, trimethylene, or tetramethylene and $R^1$ and $R^2$ are identical or different, substituted or unsubstituted alkyls or alkenyls of from 5 to 75 carbon atoms or $R^1$ is hydrogen and $R^2$ is the group of the formula $$R^3R^4N—[C_nH_{2n}O]_x—C_nH_{2n}—,$$

where $R^3$ and $R^4$ are identical or different hydrocarbon radicals of from 1 to 18 carbon atoms, n is 3 or 4, and x is from 4 to 99.

2. A fuel as defined in claim 1 wherein the tricarboxylic acid is citric acid or nitrilotriacetic acid and the tetracarboxylic acid is ethylenediaminetetraacetic acid.

3. A fuel as defined in claim 1 wherein the salts are selected from the group consisting of lithium, sodium, potassium, rubidium, cesium, calcium, magnesium and mixtures thereof.

4. A fuel as defined in claim 1 wherein the salts are those of potassium.

5. A fuel as defined in claim 1 wherein the radicals $R^1$ and $R^2$ are the hydrocarbon radical $C_{13}H_{27}$—.

6. The fuel of claim 1, wherein the mass fraction of the fuel additive is from 50 ppm to 1000 ppm.

7. The fuel of claim 1, wherein $R_3$ and $R_4$ are identical or different hydrocarbon radicals of from 4 to 13 carbon atoms.

8. The fuel of claim 1, wherein n is 3 and 4.

* * * * *